US006484108B1

(12) United States Patent
Burgmayer et al.

(10) Patent No.: US 6,484,108 B1
(45) Date of Patent: Nov. 19, 2002

(54) METHOD FOR PREDICTING RECOVERY BOILER LEAK DETECTION SYSTEM PERFORMANCE

(75) Inventors: Paul R. Burgmayer, Wayne, PA (US); Ke Hong, Kendall Park, NJ (US); John C. Gunther, Bensalem, PA (US)

(73) Assignee: GE Betz, Inc., Trevose, PA (US)

( * ) Notice: Subject to any disclaimer, the term of this patent is extended or adjusted under 35 U.S.C. 154(b) by 175 days.

(21) Appl. No.: 09/587,489

(22) Filed: Jun. 5, 2000

Related U.S. Application Data

(63) Continuation-in-part of application No. 08/938,191, filed on Sep. 26, 1997, now Pat. No. 6,076,048.

(51) Int. Cl.[7] ..... G01M 3/02; G01M 3/26; G01M 15/00

(52) U.S. Cl. ..... 702/51; 702/49.7; 702/50; 702/29

(58) Field of Search ..... 702/51, 49.7, 50, 702/29; 73/40.5; 364/509

(56) References Cited

U.S. PATENT DOCUMENTS

| | | | | |
|---|---|---|---|---|
| 4,897,797 A | | 1/1990 | Free, Jr. et al. | |
| 5,304,800 A | | 4/1994 | Hoots et al. | |
| 5,315,530 A | | 5/1994 | Gerhardt et al. | |
| 5,320,967 A | | 6/1994 | Avallone et al. | |
| 5,363,693 A | | 11/1994 | Nevruz | |
| 5,471,400 A | | 11/1995 | Smalley et al. | |
| 5,565,619 A | | 10/1996 | Thungstrom et al. | |
| 5,663,489 A | | 9/1997 | Thungstrom et al. | |
| 5,756,880 A | | 5/1998 | Chen et al. | |
| 5,757,664 A | * | 5/1998 | Rogers et al. | 364/509 |
| 5,817,927 A | | 10/1998 | Chen et al. | |
| 5,847,266 A | * | 12/1998 | Nevruz | 73/40.5 |
| 6,076,048 A | * | 6/2000 | Gunther et al. | 702/51 |

OTHER PUBLICATIONS

Nevruz, A., A Proven and Patented Method To Detect Small Leaks in The Recovery Boiler, TAPPI Eng. Conf, 1995, pp. 479–484 (No month).

Buckner, et al., Design & Implementation of a Commercial Acoustic Leak–Detection System for Black Liquor Recovery, TAPPI Journal, Jul. '90, pp. 121–127.

Racine, et al., An Expert System for Detecting Leaks in Recovery–Boiler Tubes, TAPPI Journal, Jun. '92,pp. 147–152.

Durham, et al., Black Liquor Recovery Boiler Leak Detection: Indication of Boiler Water Loss Using a Waterside Chemical Mass Balance Method, TAPPI Journal, Nov. 95, pp. 144–155.

Introduction: Problem: A boiler–Tube Leak Can Lead to a Catastrophic Smelt–Water Explosion in the Lower Section Of the Recovery Boiler (RB), Union Camp Corporation Presentation, 1996 pp. 1–24 (No month).

Grace, T. Acoustic Leak Detection—One Answer to a Need, Inst. Of Paper Chem. (PIMA), Dec. '98. pp. 1–2.

(List continued on next page.)

*Primary Examiner*—John S. Hilten
*Assistant Examiner*—Tung S Lau
(74) *Attorney, Agent, or Firm*—Caesar, Rivise, Bernstein, Cohen & Pokotilow, Ltd.

(57) ABSTRACT

A system and method for presenting the tradeoffs among the sensitivity, false alarms and off-line operation of recovery boiler leak detection systems. For any given recovery boiler, the system and method utilizes prior data from that recovery boiler to provide the operator of that boiler with the ability to balance how sensitive the recovery boiler leak detection system can be along with how many false alarms of the recovery boiler leak detection system will be tolerated and along with how much off-line operation of the recovery boiler leak detection system will be acceptable.

3 Claims, 11 Drawing Sheets

OTHER PUBLICATIONS

Nevruz, Real Recovery Boiler Leaks and How to Detect Them, Int'l Chem Recovery Conf. TAPPI, Jun. '98, pp. 2–5.
Gommi, J., Status of Leak Detection Methods for Recovery Units in North America, TAPPI Jrnl, vol. 81,No. 10, Oct. '98, pp. 69–75.
Racine, J., Recovery Boiler Advisor helps Mills to Diagnose Tube Leaks, Papermaker, Mar. '95, pp. 21–23.
Marziale et al., Using Sound to Detect Boiler Leaks, TAPPI Jrnl, Jul. '89, pp. 67–71.
Diambri, et al., Use of Waterside Tracers To Enhance Recovery Boiler Leak Indication, TAPPI Eng. Process Conf.& Trade Fair, 1999, pp. 437–442 (No month).

Gommi, J., Root Causes of Recovery Boiler Leaks, Int'l Chem Conf., TAPPI Jrnl, Sep. '98, pp. 72–80.

Dukelow, S., The Control of Boilers, Instrument Society of America, 1986, pp. 1–2 and 110–114.

* cited by examiner

METHOD FOR PREDICTING RECOVERY BOILER LEAK DETECTION SYSTEM PERFORMANCE

RELATED APPLICATIONS

This application is a Continuation-in-Part of application Ser. No. 08/938,191, filed Sep. 26, 1997, now U.S. Pat. No. 6,076,048, entitled SYSTEM AND METHOD FOR LEAST SQUARES FILTERING LEAK FLOW ESTIMATION/DETECTION USING EXPONENTIALLY SHAPED LEAK PROFILES, assigned to the same Assignee, namely, BetzDearborn, Inc., as the present invention and whose entire disclosure is incorporated by reference herein.

FIELD OF THE INVENTION

This invention relates generally to the field of leak detection in process systems and, more particularly, for leak detection performance in boilers such as black liquor recovery boilers of any other area where the detection of leak created mass imbalances using online measurements is of interest.

BACKGROUND OF THE INVENTION

Early detection of recovery boiler leaks continues to be an important objective of power and recovery operations because of the serious consequences of a water leak into the recovery boiler furnace. The leak detection techniques currently in use can generally be classified into four categories: (1) operator observations; (2) acoustic systems; (3) chemical mass balance systems; and (4) water mass balance systems. Each method has its own inherent strengths and weaknesses. The need for multiple methods of detection as a means to overcome individual weaknesses and ensure reliable detection also has been documented.

The application of the present invention is directed to providing boiler operators with tradeoffs among sensitivity, false alarms and offline periods of leak detection systems that use water or chemical mass balance methods around a recovery boiler. For a water mass balance (WMB), flow meters around the waterside of the boiler are used to calculate the balance of water entering and leaving the boiler. The chemical mass balance (CMB) technique relies on a combination of flow measurements and chemical concentration measurements to calculate the mass balance of a specific stable and non-volatile species (such as phosphate or molybdate) around the waterside of the boiler. In either case, if a statistically significant loss is calculated a water leak is suspected and an alarm is triggered to alert the operator.

Typically, there is interest in detecting leaks of 1,000 to 10,000 lb/hr or 0.1% to 1% of a typical 500,000 lb/hr total flow. This presents a challenge when one considers the magnitude and type of noise or variation that exists in a calculated water or chemical mass balance signal. For a water mass balance system, noise arises from the inherent variability of steam and water flows, the flow meters measuring them, and the drum level control circuit. An indication of the noise associated with a calculated water mass balance is shown in Table 1. The calculated standard deviation of a water mass balance is shown for five study recovery boilers at times when their loads were relatively stable.

Three observations can be made from Table 1: First, the magnitude of the noise presents a distinct challenge in meeting the stated leak detection goal (less than 2% of steam load). Second, the magnitude of the noise varies among boilers. The differences are primarily due to the differing degrees of sophistication and care taken in tuning the drum level control circuit. The mass balance noise is primarily related to the variation in time response (lag) between an altered steam flow and the responding change in feedwater pumping rate. Third, the noise is variable for a given boiler over a daily and even weekly basis. Any water mass balance method requires some way to manage this flow-related noise.

For chemical mass balance, the situation is improved as the number of measurements and their noise levels are lower than water mass balance. One of two related approaches have been used. In the first, the concentration of a tracing or treatment chemical (entering at fixed concentration) and exiting the boiler are determined while holding the ratio of feedwater to blowdown flow fixed. In the second, the pumping rate of a chemical of known concentration is measured while the blowdown chemical concentration and flowrate are measured.

In the first case, the measurements are chemical concentrations entering and exiting the boiler. In the second, they are product chemical concentration (fixed), pumping rate of that chemical, blowdown flow and blowdown chemical concentration. Noise levels for the individual measurements of the second method have been determined and are shown in the Table 2.

In addition to the random noise discussed above, steam loads in recovery boilers often vary due to liquor heating value variation, control of liquor supply, operation of other boilers in the system, and other process influences. FIG. 1 shows the duration vs. % load drops in five recovery boilers taken over ¾ year to 1 year time periods. The area within ±20% on the y-axis is assumed to be normal boiler load variations and were not plotted. As can be seen from the plots and tables, significant load changes are a regular occurrence with recovery boilers. Also, these load changes vary in duration by quite a wide range of times. Three of the five boilers studied only decrease their steam load from "normal" steaming rates; two boilers both increase and decrease load. Steam load changes affect water mass balance leak detection systems in one of two ways: (1) Load swings alter the steam to water ratio in the boiler and thus the total mass. With a lower steam to water ratio expected at lower load, the boiler water mass increases. As the load is decreased, the mass increases which may lead to a false alarm; (2) Flow meter calibration errors vary with steam load. Demonstration of the combined effect is shown in FIG. 2 where a load drop from 500 klb/hr to 350 klb/hr leads to an apparent 15 klb/hr "leak" in a raw water mass balance.

Load changes also affect chemical mass balance systems. As the load decreases, the amount of water present in the boiler increases which dilutes the tracer or treatment chemical potentially leading to a false alarm. When the load increases back to normal, the mass of water decreases making the tracer concentration increase. The characteristic of this type of change is a sharp change in chemical concentration as the load is changed.

As can be seen from these curves plotted in FIG. 3, there is a strongly likelihood that such load drops can lead to false alarms. Given the number and duration of these load changes, mass balance systems not correcting for these will spend significant time in a false alarm state. Using the data from the five boilers shown in FIG. 1, estimates were made as shown in Table 3.

Based on the data from these five boilers, a mass balance not correcting for load changes could expect false alarms due solely to load changes on average every seven to fourteen days with times in alarm condition between 2% and 9%. Mass balance systems which shut down when load changes occur would be offline at these times. Alternatively, if a system were designed to avoid false alarms, but was not designed to provide load swing correction or disabling, detection limits would be relaxed to the point where the system would not be a useful detection tool.

There are other system changes that can affect mass balance measurements. One with a potentially large impact are boiler startups especially those where the boiler has been down for more than a day.

Mass balances (chemical and water) are unstable during startups. The flows will be outside normal operation and the boiler water will change as cold water is converted to a mixture of steam and water with increased steam load. To better understand this phenomena, an extensive analysis of ten boiler startups was completed for one boiler system. FIG. 4 shows steam flow and a smoothed raw water mass balance for a typical boiler startup.

The overall mass balance does not stabilize for fifteen to twenty hours. A similar situation is observed for chemical mass balance systems. An effective mass balance-based leak detection system must be able to avoid the false alarms associated with mass balance instabilities.

There are other situations where the mass balance (especially water mass balance) is briefly upset. Some of these include over-pressurization venting, momentary drum level upsets, and manual blowdown. Additionally, some boiler processes have periodic oscillations such as drum level variation (fast) or flow meter drift (slow). An effective system must deal with these without generating unnecessary false alarms.

To detect leaks using a water mass balance, all the flows of water into and out of the boiler are measured. FIG. 5 depicts an exemplary water mass balance level detection system 1. In particular, the system 1 comprises a recovery boiler 2 having a feedwater flow 3, a steam flow 4 and a blowdown flow 5. A feedwater flow signal 6, blowdown flow signal 7 and steam flow/drum level signal 8 are all conveyed to an input/output device 9. This in turn feeds these signals to a computer workstation 10 which comprises the leak detection software. For example, the system and method of application Ser. No. 08/938,191 uses these flow measurements to calculate the boiler water mass balance. If the boiler water mass balance (mass in−mass out) increases significantly a leak is suspected. Hardware requirements for water mass balance system are relatively simple. Temperature and pressure compensated flow signal must be available to close the water mass balance. In some cases additional flow signals such as attemperation water flow or sootblower steam flow may be needed if required to close the water mass balance.

Hardware requirements for chemical mass balance systems are more extensive than for water (see FIG. 6). FIG. 6 depicts an exemplary chemical mass balance leak detection system 11. The amount of chemical feed into the boiler 2 via a chemical feedline 12 is determined using a verified chemical feed 13 and control system, the latter of which comprises a chemical tank 14, a pump 15, and a controller 18 (e.g., the BetzDearborn Pacesetter Plus Controller); also a sample line and sample system 16 and residual analyzer 17 are used for determining chemical concentration. The amount leaving the boiler is determined by measuring blowdown flow rate and the chemical concentration. If a discrepancy in chemical mass balance is detected, a leak is suspected. The sample system has been designed that incorporates a special high pressure filter to allow for the continuous reliable measurement of a blowdown sample.

Having reliable equipment is a necessary but insufficient prerequisite for an effective leak detection system. As described above, there are many factors influencing chemical and water mass balance measurements in recovery boilers causing variation even when no leaks are present. Thus, the goals in leak detection are to detect as small a leak as possible, as quickly as possible, without false alarms and minimal down time.

Optimal reduction in noise related to flow and flow meters is achieved by using averaging techniques such as those disclosed in application Ser. No. 08/938,191, which include:

- exponential-weighting is used to provide moving averages of a wide range of times (one minute averages for up to a 16 hour period) without consuming huge amounts of computer memory;
- the problem of over-averaging leading to slow response for fast growing leaks, or under-averaging leading to loss of sensitivity for slow growing leaks, is handled by a having a series of averaging windows ranging from 30 minutes up to 16 hrs. These are combined to form one overall leak detection statistic that chooses the window with the most significant statistic at a particular time; and
- background subtraction using a moving average of much longer window than the expected leak growth rates is used to remove the effect of long-term (days to weeks) drift in flow meter output.

As noted above, even with optimal flow-related noise reduction, the problem of steam load-related noise can be acute in some systems leading to false alarms on a weekly basis. To correct for the artifacts introduced with load changes, load compensation algorithms have been developed such as those disclosed in U.S. Pat. No. 5,817,927 (Chen et al), which is assigned to the same Assignee as the present invention and whose entire disclosure is incorporated by reference herein.

There are two parts to these corrections for both chemical mass balance and water mass balance methods. FIGS. 7A–7C show a boiler load swing demonstrating the effectiveness of a two-step approach to largely eliminate the effect on water mass balances. FIG. 7A shows the raw water mass balance data and the steam flow. The first correction (FIG. 7B) handles the load-related offsets discussed above which provides a correction for the steam and feedwater flow calibrations. As shown in FIG. 7B, the resulting data is much closer to the unperturbed baseline needed for reliable leak detection. However there still are disturbances at the beginning and end of the load swing. These are corrected by a second term which accounts for the differences in time response between the feedwater and steam flow signals. FIG. 7C depicts both of these corrections incorporated therein.

Similar corrections can be applied to the chemical mass balance method. The results are shown in FIG. 8A (using a first chemical mass balance correction term) and FIG. 8B (using the first correction term as well as a second chemical mass balance correction term).

The startup of a cold boiler presents a difficult challenge to mass balance methods as there is no reliable way to know how the boiler load will be raised or how the boiler will respond. There can be other events that disrupt the mass balance. Some of these mentioned above include venting, drum level upsets, and manual blowdowns. For both startups and other events where the chance of a false alarm is very high, one option for increasing the reliability of a leak detection system is to bring the detection system down until the boiler condition is returned to normal.

In light of all of the above, the need to predict individual leak detection system performance prior to actual leaks has been overlooked. All of the above corrections are aimed at addressing background and system noise for a particular boiler. As demonstrated above, the noise and leak detection sensitivity are boiler specific. Thus, the ability to predict leak detection system performance presents some challenges.

Thus, there remains a need for a method for predicting the performance of any recovery boiler leak detection system that uses mass balancing by presenting the operator of the recovery boiler with tradeoffs regarding the sensitivity of the leak detection system, the number of false alarms of that system as well as the amount of system downtime.

OBJECTS OF THE INVENTION

Accordingly, it is the general object of the instant invention to provide an apparatus and methods for meeting that need.

It is a further object of this invention to provide an method for presenting tradeoffs among the sensitivity, false alarms and off-line time of a recovery boiler leak detection system.

It is still yet another object of the present invention to provide a method for presenting tradeoffs among the sensitivity, false alarms and off-line time of a recovery boiler leak detection system whereby the sensitivity is expressed as a rate for a given window of time, e.g., 7500 lbs/hour in 1 hour.

It is still yet a further object of this invention to provide a method for presenting tradeoffs among the sensitivity, false alarms and off-line time of a recovery boiler leak detection system based on water mass balance.

It is yet another object of this invention to provide a method for presenting tradeoffs among the sensitivity, false alarms and off-line time of a recovery boiler leak detection system based on chemical mass balance.

It is yet another object of this invention to provide a method for presenting tradeoffs among the sensitivity, false alarms and off-line time of a recovery boiler leak detection system based on a fixed concentration of chemical into and out of the recovery boiler.

It is still yet another object of the present invention to provide a method for characterizing the performance of a leak detection system for a recovery boiler.

It is still yet even another object of the present invention to provide a method for characterizing the performance of a leak detection system for a recovery boiler based on the particular operation of the recovery boiler.

It is still yet a further object of this invention to provide a method for presenting tradeoffs among the sensitivity, false alarms and off-line time of a recovery boiler leak detection system used with a recovery boiler that may or may not be base-loaded.

SUMMARY OF THE INVENTION

These and other objects of the present invention are achieved by providing a method for presenting tradeoffs of the sensitivity, false alarms and offline operation of a recovery boiler leak detection system. The method comprises the steps of: (a)obtaining leak-free operational data from the recovery boiler; (b) specifying a leak probability estimating filter (e.g., a filter having a mass balance-based leak flow estimation model of the recovery boiler, a statistical noise model and a model of how typical leaks grow over time); c) generating a numerical indicator (e.g., a leak probability statistic) from the filter and the operational data and wherein the numerical indicator has an output that is a measure of leak likelihood; (d) specifying a condition or conditions wherein the numerical indicator output is undefined; (e) selecting an alarm limit for the recovery boiler leak detection system wherein if said numerical indicator output exceeds the limit, an alarm is activated in the recovery boiler leak detection system; (f) determining the sensitivity of the leak detection system from one of a first sequence of numerical indicator outputs that exceeds the alarm limit in the least amount of time and wherein the first sequence of numerical indicator outputs is generated from simulated recovery boiler inputs and an assumed leak that are fed into the filter; (g) determining the number of false alarms and offline times from a second sequence of numerical indicator outputs that exceed the alarm limit or are undefined, respectively, and wherein the second sequence of numerical indicator outputs is generated by a sequence of the operational leak-free data that are fed into the filter; and (h) presenting tradeoffs among the sensitivity, false alarms and offline times.

DESCRIPTION OF THE DRAWINGS

Other objects and many of the intended advantages of this invention will be readily appreciated when the same becomes better understood by reference to the following detailed description when considered in connection with the accompanying drawings wherein:

FIG. 10 is a layout of FIGS. 10A and 10B;

DETAILED DESCRIPTION OF THE PREFERRED EMBODIMENTS

It should be noted that the method of the present invention, as discussed below, is based on mass balancing, which includes water mass balancing (WMB) or chemical mass balancing (CMB) around the recovery boiler process. Furthermore, it is within the broadest scope of this invention to also include recovery boiler modeling that is based on the monitoring of a chemical concentration into the recovery boiler and out of the recovery boiler and whether that concentration is fixed or not. As a result, the term "mass balance" as used in this application includes all of the above bases.

Figure 1:
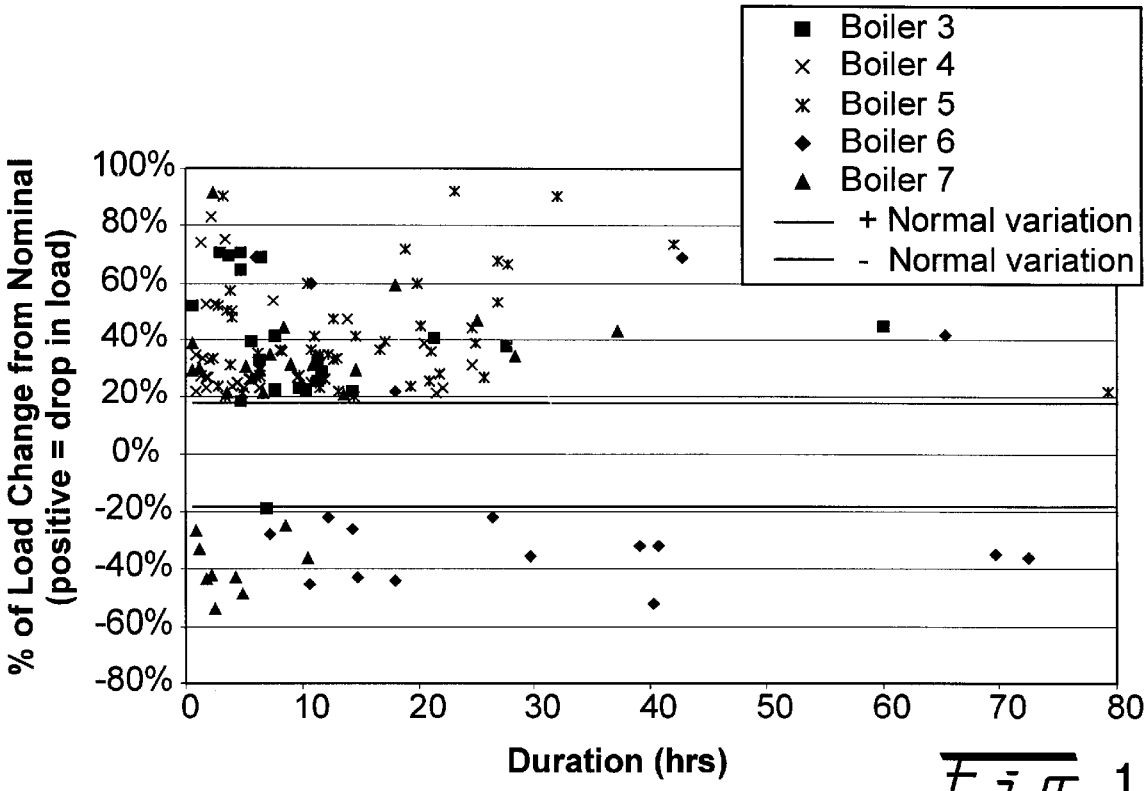
FIG. 1 is a graphical depiction of percentage of recovery boiler load changes vs. duration.
Figure 2:
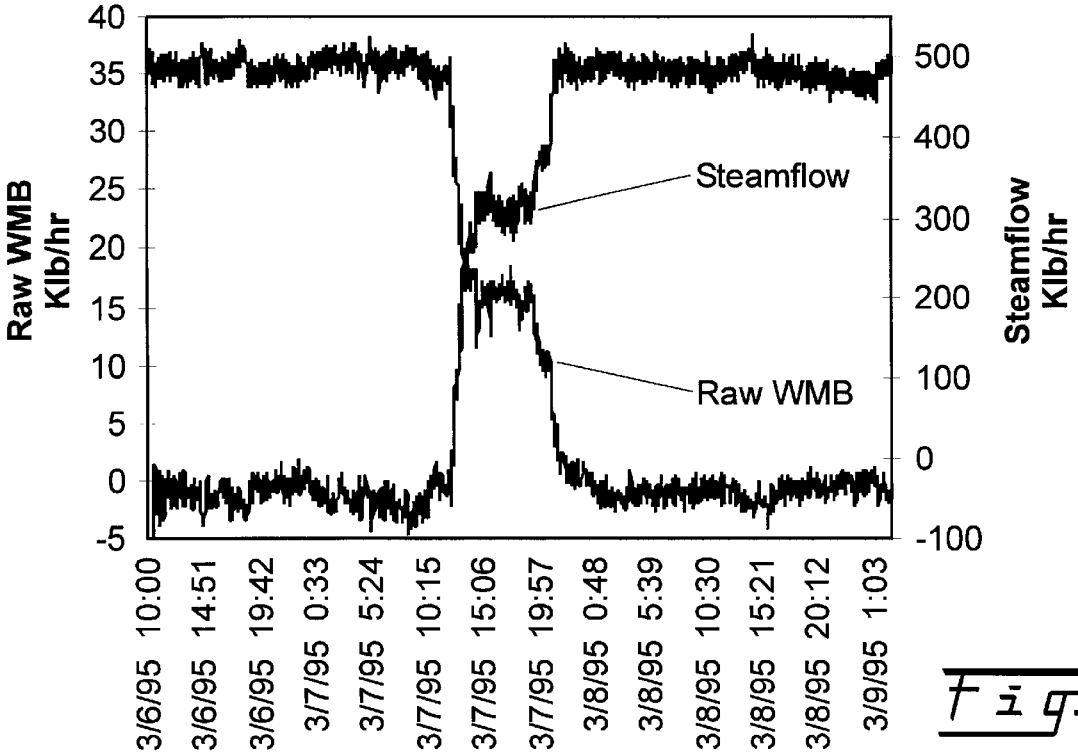
FIG. 2 depicts a test recovery boiler's steam flow and water mass balance data with no correction that may trigger a false alarm.
Figure 3:
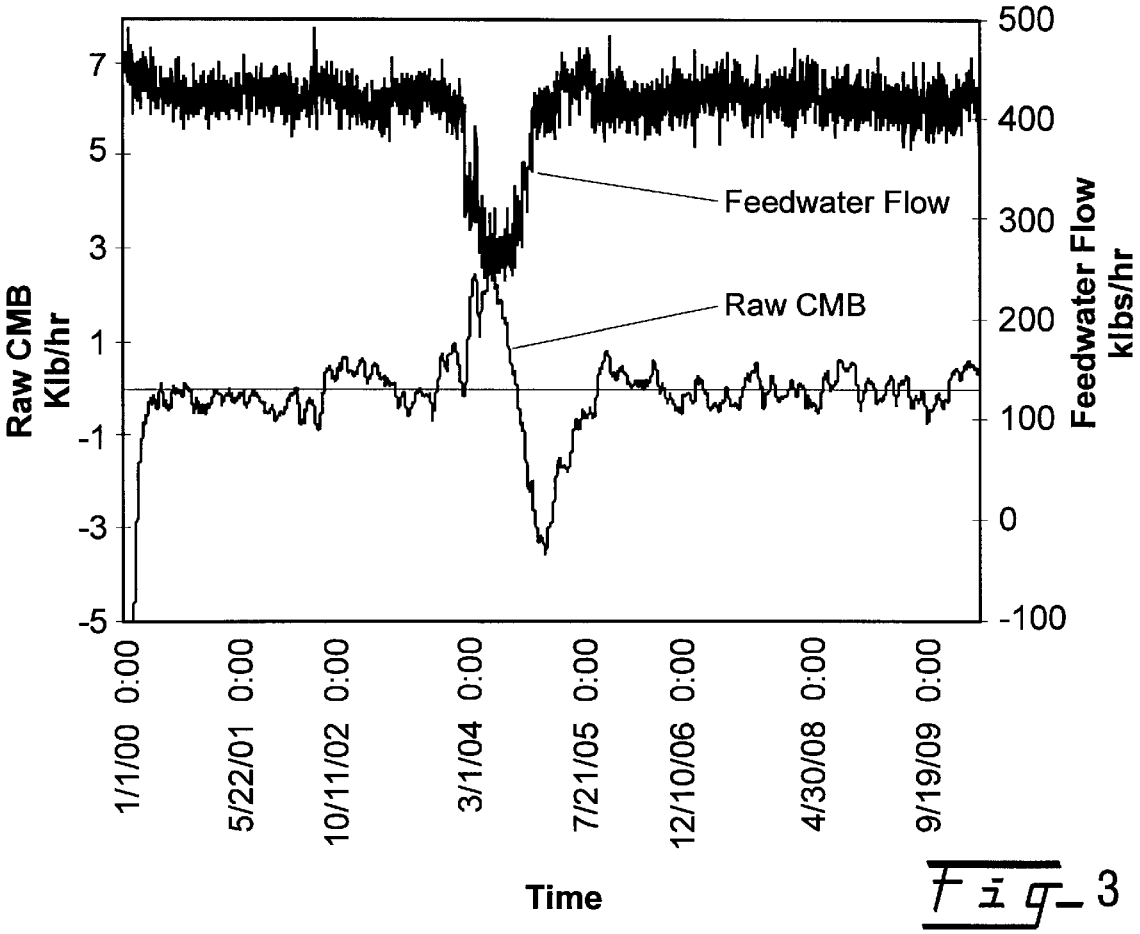
FIG. 3 depicts a test recovery boiler's feedwater flow and chemical mass balance data with no correction that may also trigger a false alarm.
Figure 4:
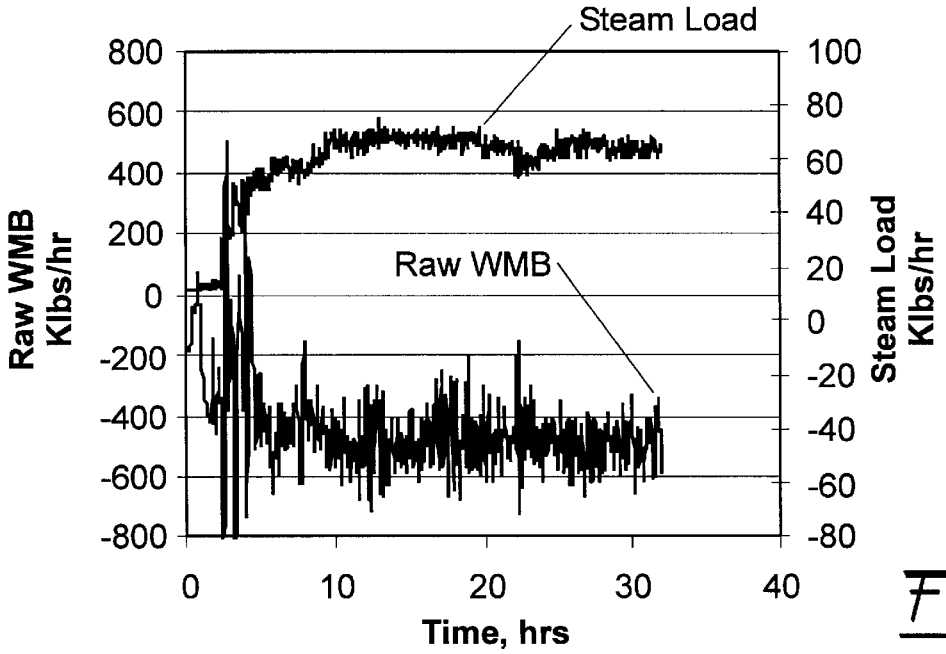
FIG. 4 depicts a test recovery boiler's steam load and smoothed water mass balance data after boiler startup.
Figure 5:
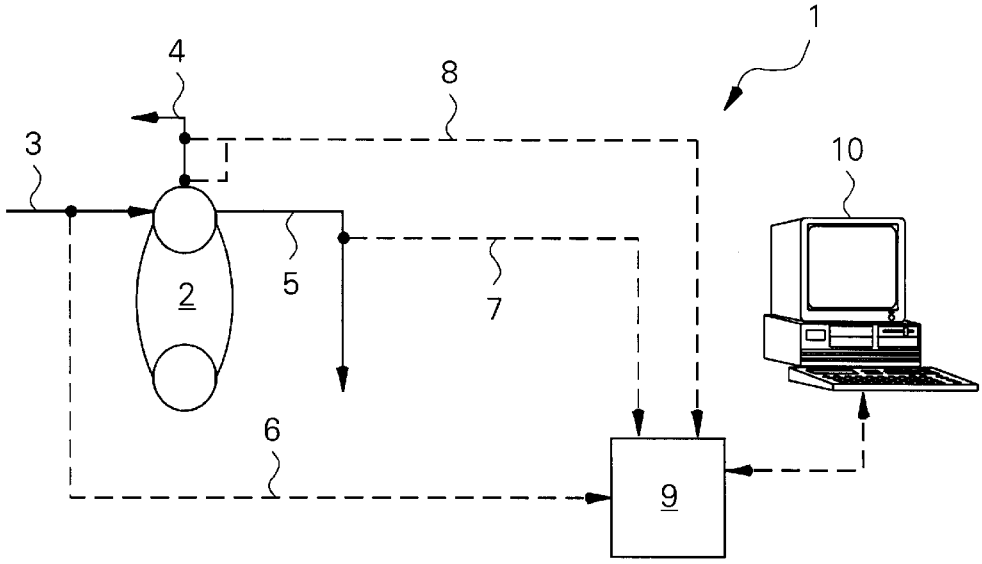
FIG. 5 is a block diagram of an exemplary water mass balance leak detection system.
Figure 6:
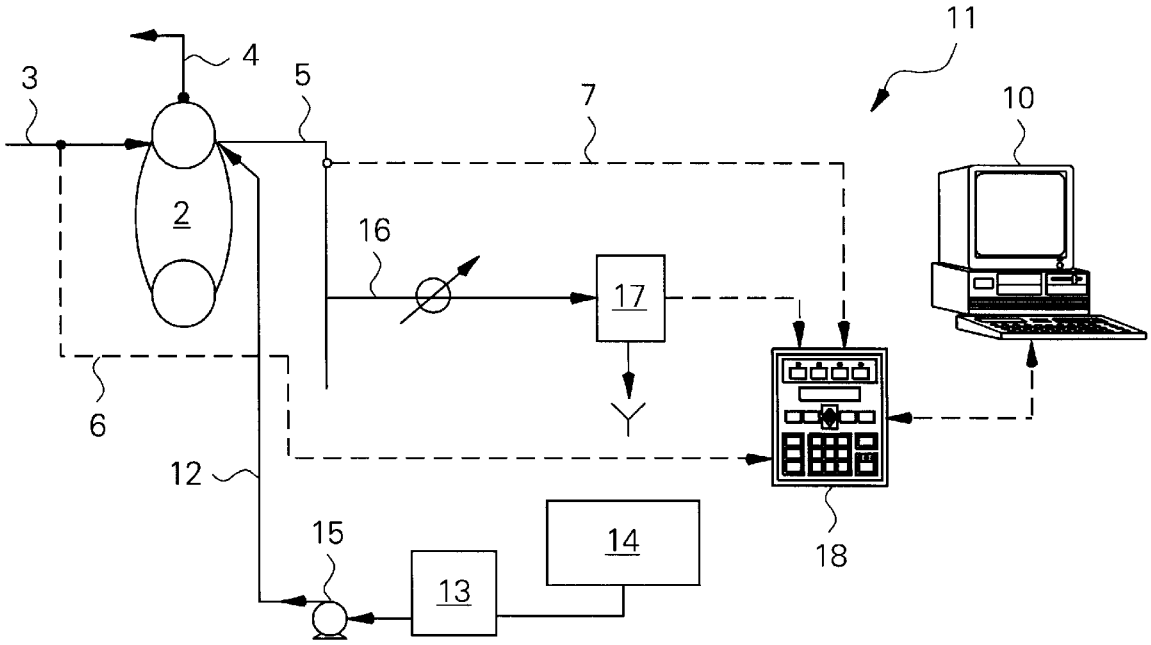
FIG. 6 is a block diagram of an exemplary chemical mass balance leak detection system.
Figure 7A:
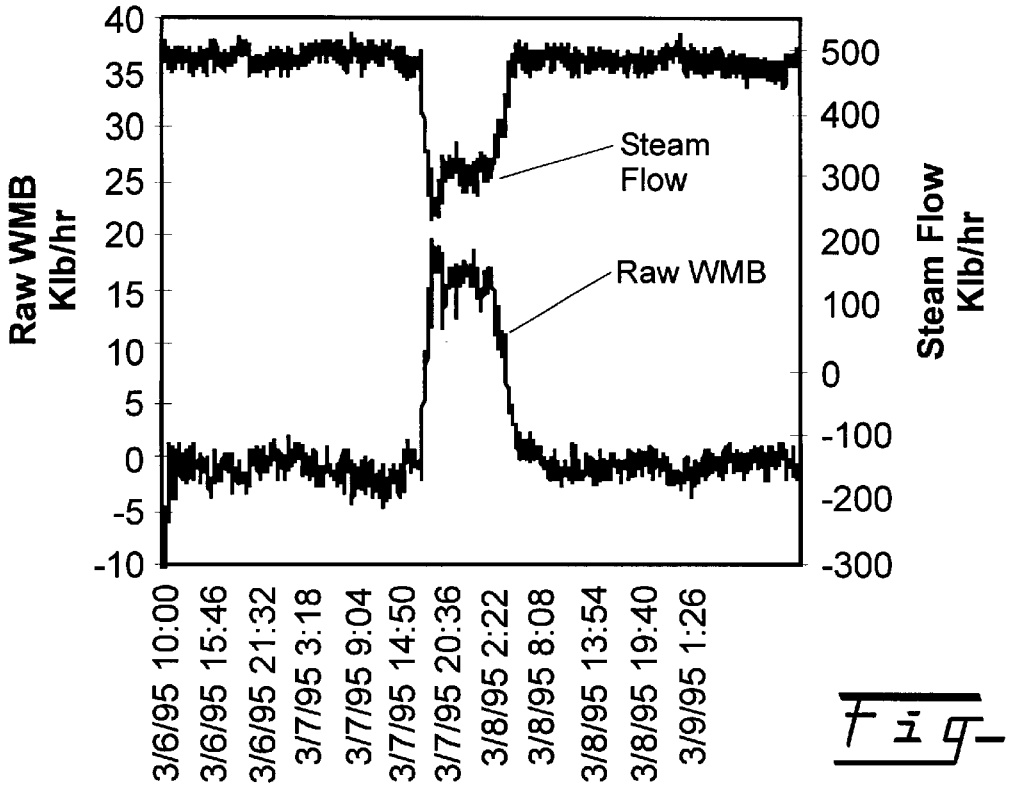
FIGS. 7A–7C depict two levels of correction for a water mass balance-based leak detection system in a recovery boiler.
Figure 7B:
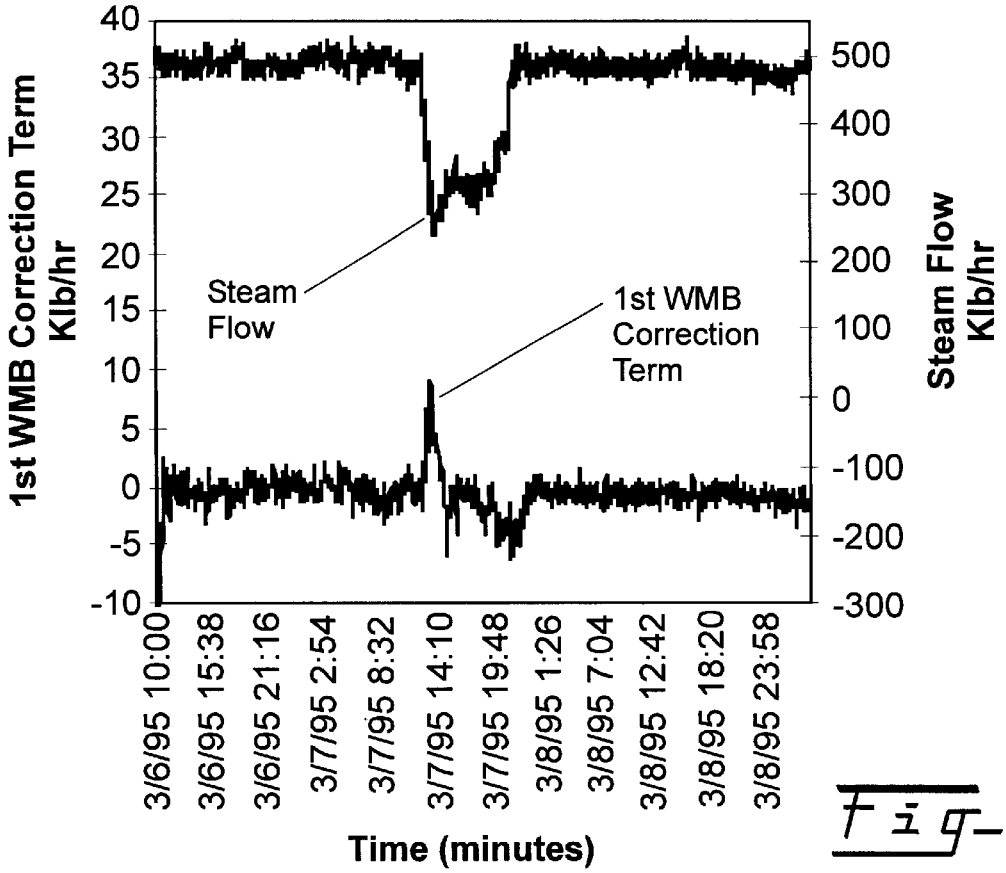
Figure 7C:
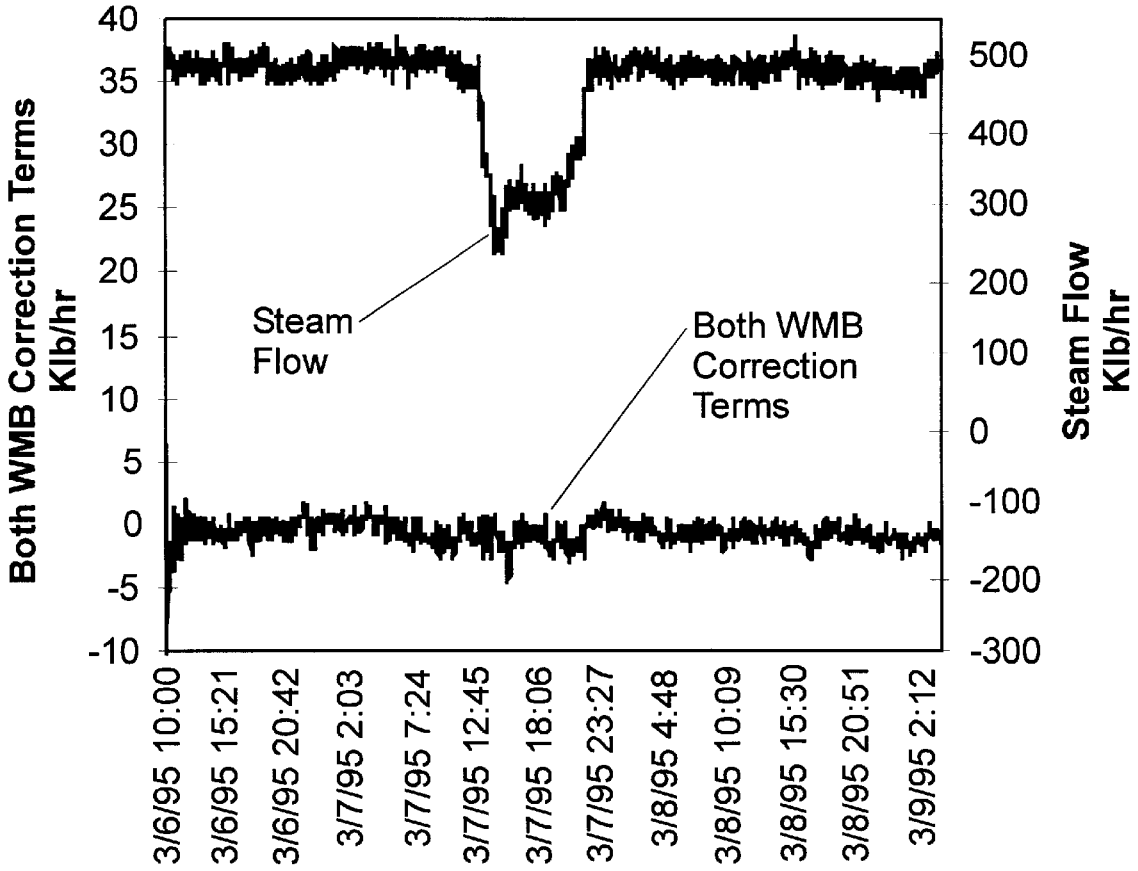
Figure 8A:
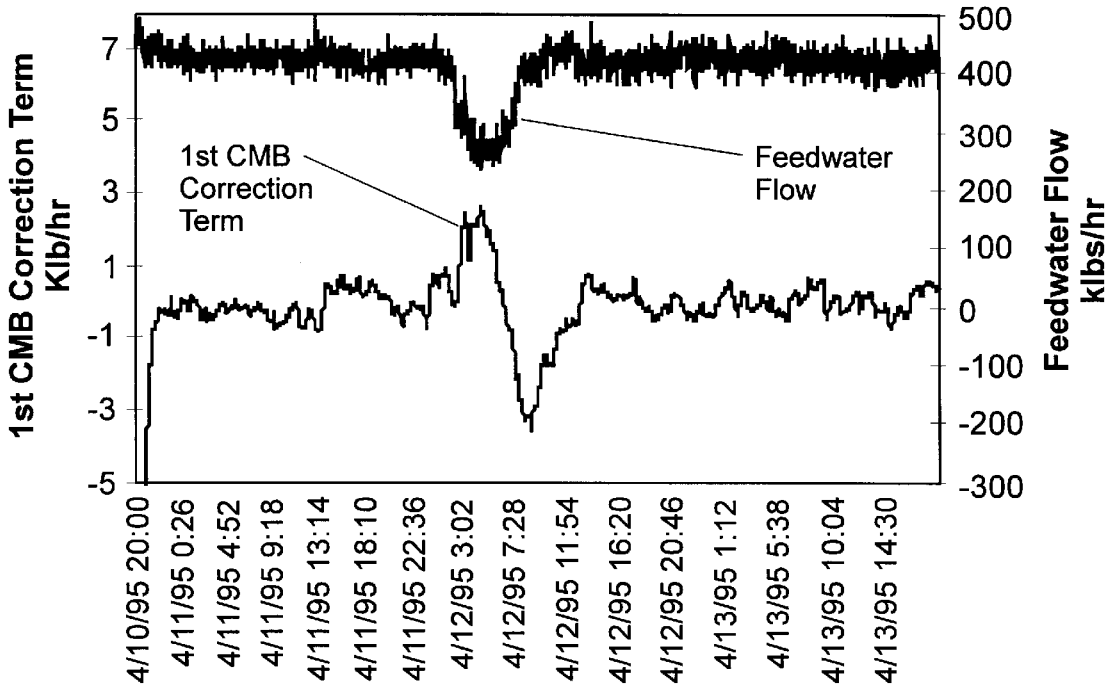
FIGS. 8A–8B depict two levels of correction for a chemical mass balance-based leak detection system in a recovery boiler.
Figure 8B:
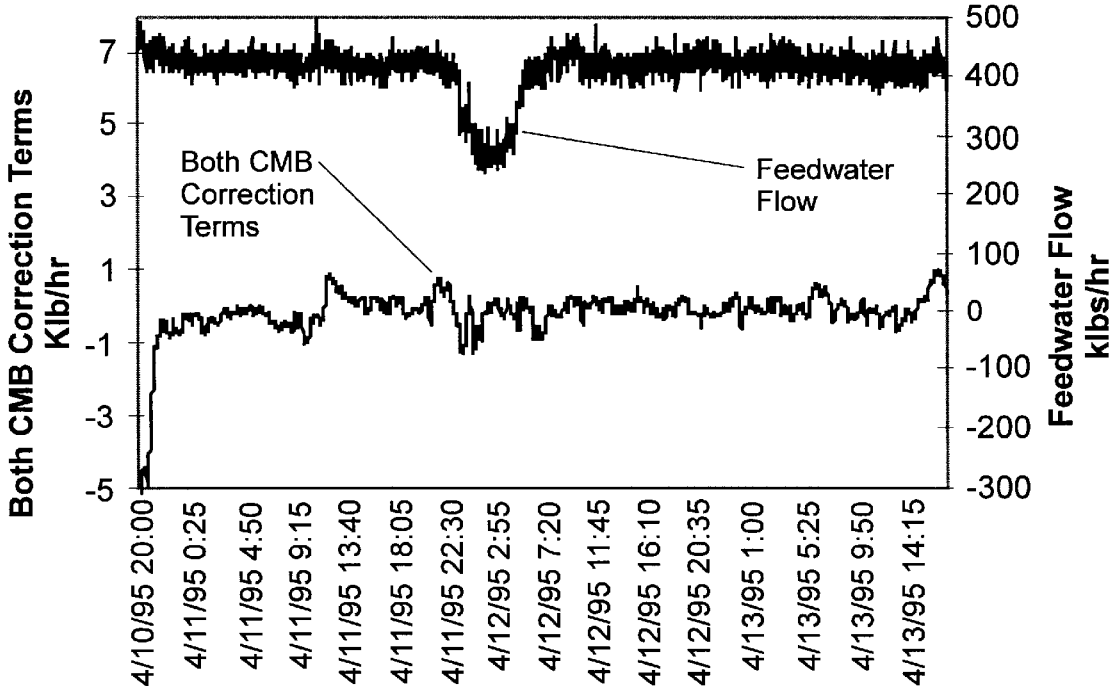
Figure 9:
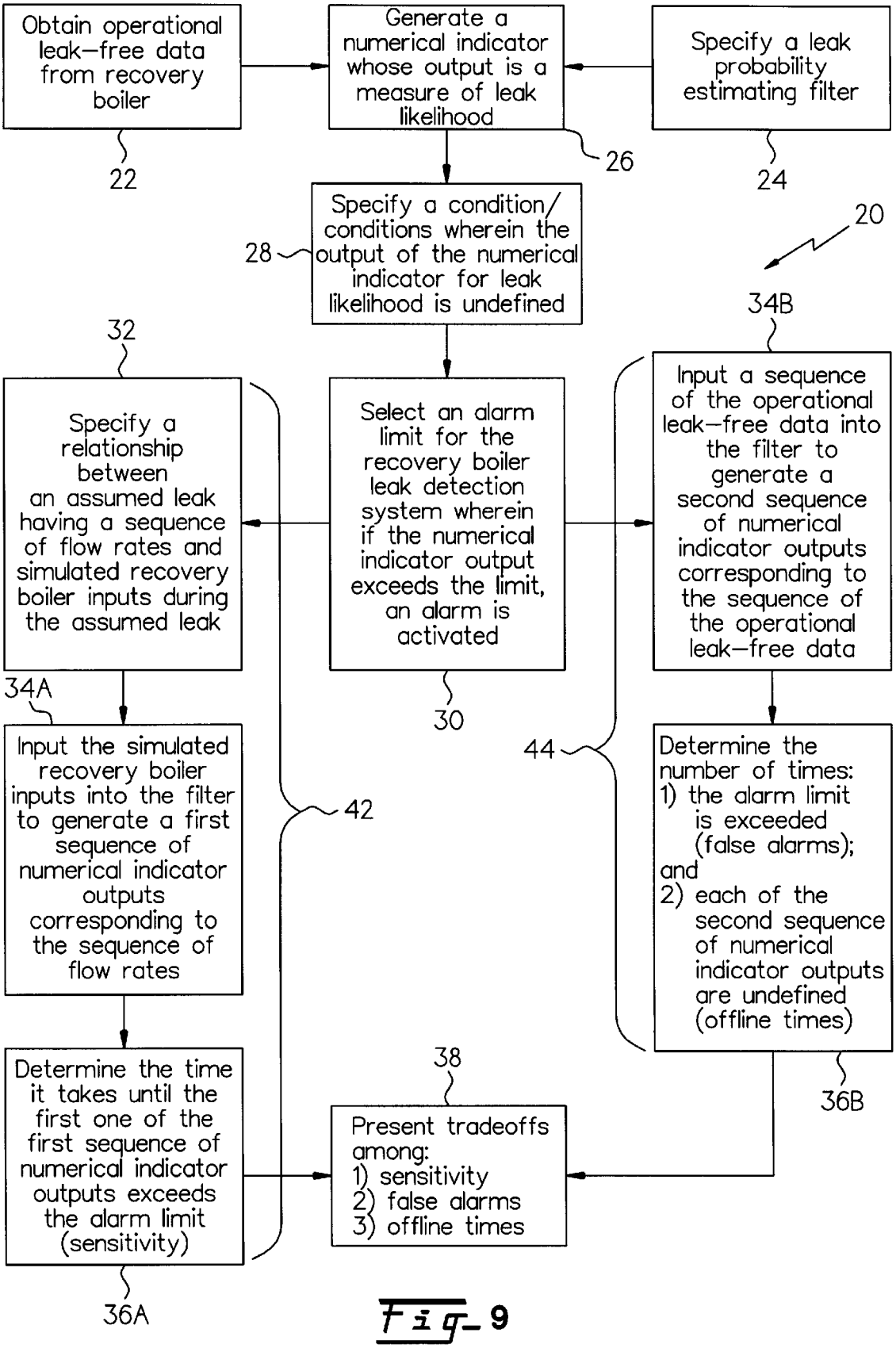
FIG. 9 is a block diagram of the method used in the present invention.

Referring now in detail to the various figures of the drawing wherein like reference characters refer to like parts, there is shown at 20 in FIG. 9, a method for presenting tradeoffs among the sensitivity, false alarms and off-line time of a recovery boiler leak detection system that utilizes mass balancing. The method 20 can be implemented in software in the computer workstation 10 of either the WMB system (FIG. 5) or the CMB system (FIG. 6).

As shown in FIG. 9, operational leak-free data from the recovery boiler is collected in step 22. A typical amount of such data is approximately one month's worth of data although this is by way of example and not limitation.

Figure 10A:
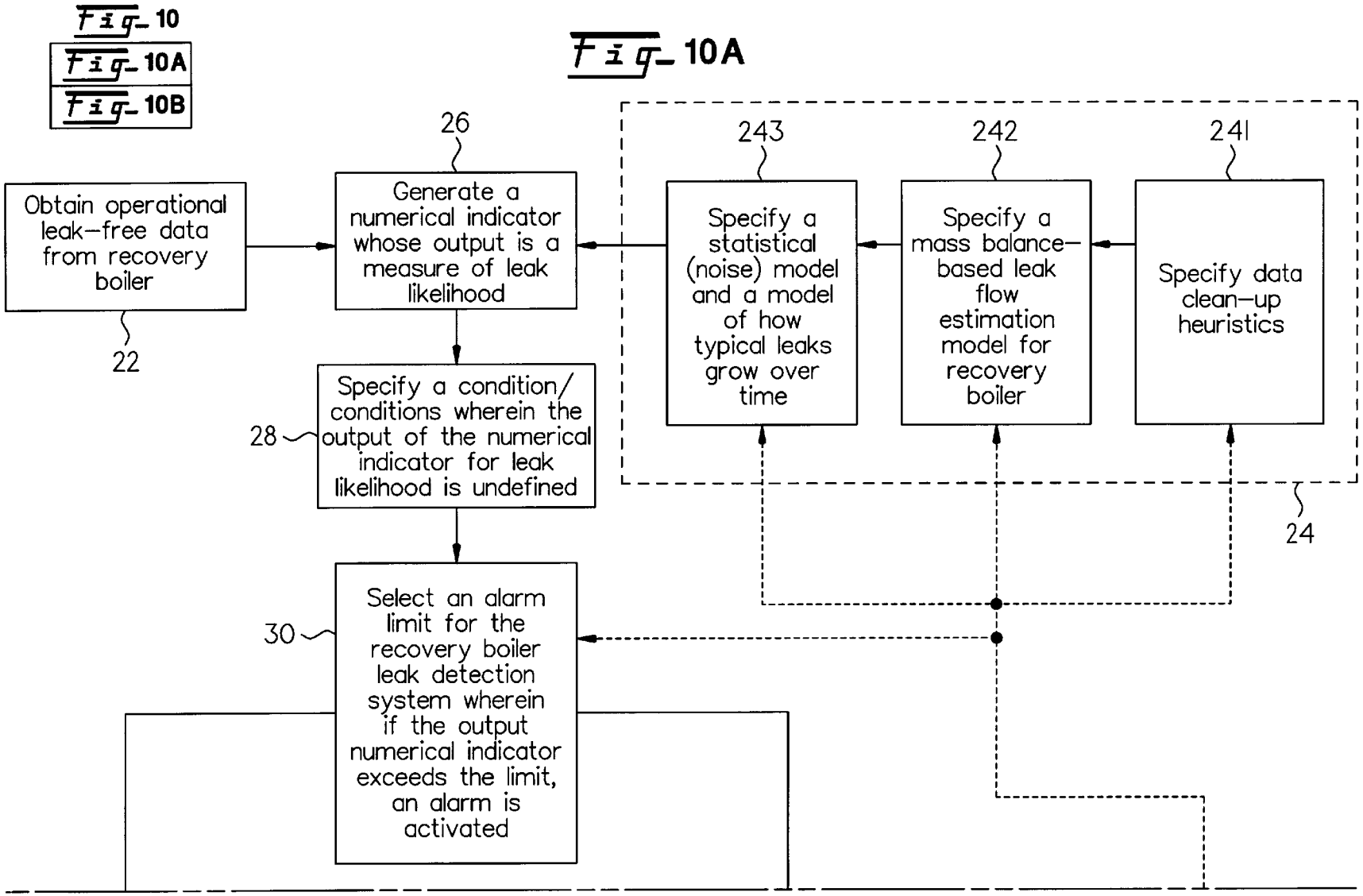
FIGS. 10A and 10B together constitute a block diagram of the method used in the present invention further defining the steps of creating a leak probability estimating filter as well as modifying earlier steps of the method.
Figure 10B:
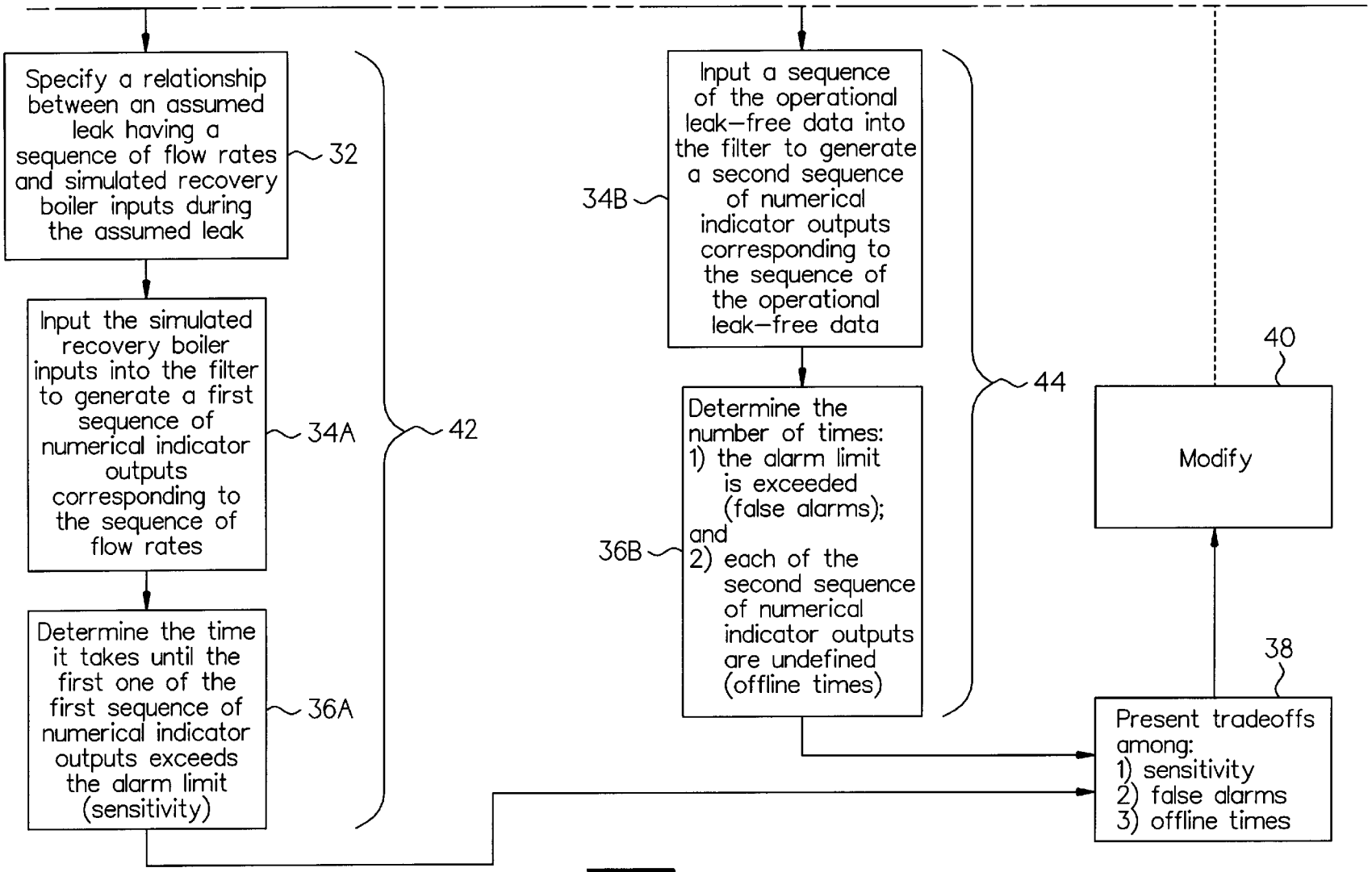

In step 24, a leak probability estimating filter is specified. It is within the broadest scope of the invention that the term "leak probability estimating filter" broadly covers any filter that distinguishes between ordinary background noise and unusual leak-like changes in the mass balance around the recovery boiler. As shown in FIG. 10A, the leak probability estimating filter specification step 24 can be further defined as the following steps: specifying data clean-up heuristics 241, specifying a mass balance-based leak flow estimation model for recovery boiler 242 and specifying a statistical (noise model) and a model of how typical leaks grow over time 243. One such example filter is the three part filter (process model component, leak model component and residual component) that partitions the variability associated with the mass flow imbalances measured around a recovery boiler which is disclosed in application Ser. No. 08/938,191, whose entire disclosure is incorporated by reference herein. Other examples of such leak probability estimating filters are those disclosed in U.S. Pat. No. 5,320,967 (Avallone) and U.S. Pat. No. 5,363,693 (Nevruz), both of whose entire disclosures are also incorporated by reference herein, as well as the Recovery Boiler Advisor™ by Stone & Webster Advanced Systems Development Services, Inc./American Forest & Paper Association ("Recovery Boiler Diagnostic System", 1992). The term "leak probability estimating filter" also includes the use of expert systems such as that disclosed in "An Expert System for Detecting Leaks in Recovery Boiler Tubes" by Racine et al., 1992. The term "leak probability estimating filter" also includes the use of fuzzy logic and artificial intelligence algorithms. Thus, the term "leak probability estimating filter" broadly covers recovery boiler leak detection systems and methods that are known to those skilled in the art.

Next, in step 26 a numerical indicator whose output is a measure of leak likelihood is generated from the operational leak free data of step 22 and from the leak probability estimating filter of step 24. By way of example and not limitation, one example of such a leak indicator is a leak probability statistic defined as the "standardized maximum likelihood standardized leak flow" (SMLSLF) statistic that is disclosed in application Ser. No. 08/938,191 which represents a single leak detection signal that can detect both slow-growing and fast-growing leaks. However, it should be understood, the term "numerical indicator whose output is a measure of leak likelihood" broadly covers any combination of variables, not just a single value, that provides some type of leak likelihood that can be compared to an alarm limit as discussed below.

As another example of such a numerical indicator, it is supposed that no data clean-up is required (step 241) and that the mass balance-based estimate of leak flow is the difference between the total recovery boiler influent flows and total recovery boiler effluent flows (step 242). Furthermore, it also supposed that the noise on the resulting mass balance-based leak flow estimates are known to be normally and independently distributed with a mean of zero, and that only leaks large enough to create statistically significant changes in the mass balance immediately (e.g., without additional averaging over time) are of interest (step 243). In this case, the leak probability estimating filter has one undetermined parameter: the standard deviation of the noise. Then the step of generating a numerical indicator whose output is a measure of leak likelihood (step 26) consists of estimating the standard deviation of the leak flow estimates produced from the leak free data of step 22 and then applying the inverse cumulative normal distribution in the well-known manner (e.g., as in a "one-tailed test") to determine the likelihood of a leak.

In step 28 a condition, or conditions, are specified where the output of this numerical indicator of leak likelihood is undefined. Where a minimum amount of recovery boiler operational data is unavailable, the output of the numerical indicator cannot be determined and is therefore declared undefined. For example, if the output of the numerical indicator is a standardized leak statistic and it is based on a 1 hour moving average of the estimated leak flow and the minimum required data fraction is 0.5, if more than half of the data collected in the last hour were outside specified hard limits, the standardized leak statistic would be undefined.

Where the output of the numerical indicator is undefined the leak detection system is brought offline. It should be understood that the term "offline" is defined in its broadest sense and covers those scenarios where the leak detection system is literally turned off for a certain amount of time, as well as those scenarios where the leak detection system is "de-tuned", i.e., the leak detection system remains powered but with such low sensitivity that it is effectively "offline."

The next step 30 requires that an alarm limit be selected wherein if the output of the numerical indicator exceeds that limit an alarm in the leak detection system is activated. It should be understood that this alarm limit need not be a single value but may be an alarm state comprising a plurality of variables, any one of which, when exceeded causes an alarm.

Once the alarm limit is selected in step 30, the method 20 branches into two parallel paths 42 and 44: one path 42 for determining the leak detection system sensitivity and the other path 44 for determining the number/duration of false alarms, as well as the number/duration of the offline times, of the leak detection system.

In particular, path 42 comprises the following steps: step 32 establishes a relationship between an assumed leak having a sequence of flow rates and simulated recovery boiler inputs present during the assumed leak. As a result, there is a correlation between leak activity and the simulated recovery boiler inputs. Once this relationship is defined, in step 34A, the simulated recovery boiler inputs are fed into the leak probability estimating filter which generates a corresponding sequence of numerical indicator outputs.

In step 36A, the time it takes for the first one of this sequence of numerical indicator outputs to exceed the alarm limit is determined (e.g., either by calculation or by monitoring the filter response). Thus, a sensitivity of the leak detection system is determined, e.g., 7.5 klb/hr in 1 hour.

It should be understood that the terms "assumed leak" and "simulated recovery boiler inputs" are not limited to just software-generated leaks (e.g., mathematically-generated) and recovery boiler inputs. For example, an "assumed leak" can be generated using the actual recovery boiler, e.g., opening a valve, etc., and then the recovery boiler inputs can be measured. Thus, the data from this "physically-introduced" leak and measured recovery boiler inputs are then inputted into the leak probability estimating filter in accordance with the above steps. In addition, where the "assumed leaks" and "simulated recovery boiler inputs" are generated in software, random noise is imposed in the data. In the case where the leak is physically introduced into the actual recovery boiler and the recovery boiler inputs measured, actual noise is inherent in the data.

Path 44 comprises the following steps: in step 34B a sequence of the recovery boiler operational leak-free data is fed into the leak probability estimating filter which generates a corresponding sequence of numerical indicator outputs to the sequence of recovery boiler operational leak-free data. In step 36B, the number of times that an alarm limit is exceeded (i.e., false alarm) is determined, along with the duration of the period that it exceeds that limit and the number of times that each one of the corresponding sequence of numerical indicator outputs is undefined (offline), along with the duration of that undefined condition.

All of this data is collected and then presented to the recovery boiler operator in step 38 to provide tradeoffs among the sensitivity, false alarms and offline times to the operator.

To further quantify these tradeoffs, as shown in FIGS. 10A/10B, a modification step 40 is provided. In particular, one or more of a plurality of modifications can be made, e.g., changing the leak probability estimating filter and/or the alarm limit. Furthermore, where the leak probability estimating filter is modified, any one or more of the steps 241–243 can be changed such as modifying the data cleanup heuristics, the leak flow estimation model and the statistical model. Once modified, the method 20 is then re-run and any changes in the sensitivity, false alarms and offline times are noted and then presented to the recovery boiler operator. As an example, introducing median filters into the data cleanup heuristics may reduce false alarms at the expense of introducing delay in the time it takes for the numerical indicator to reach a given alarm limit. Operators that value low false alarm rates over sensitivity might decide to use a median filter.

Figure 11:
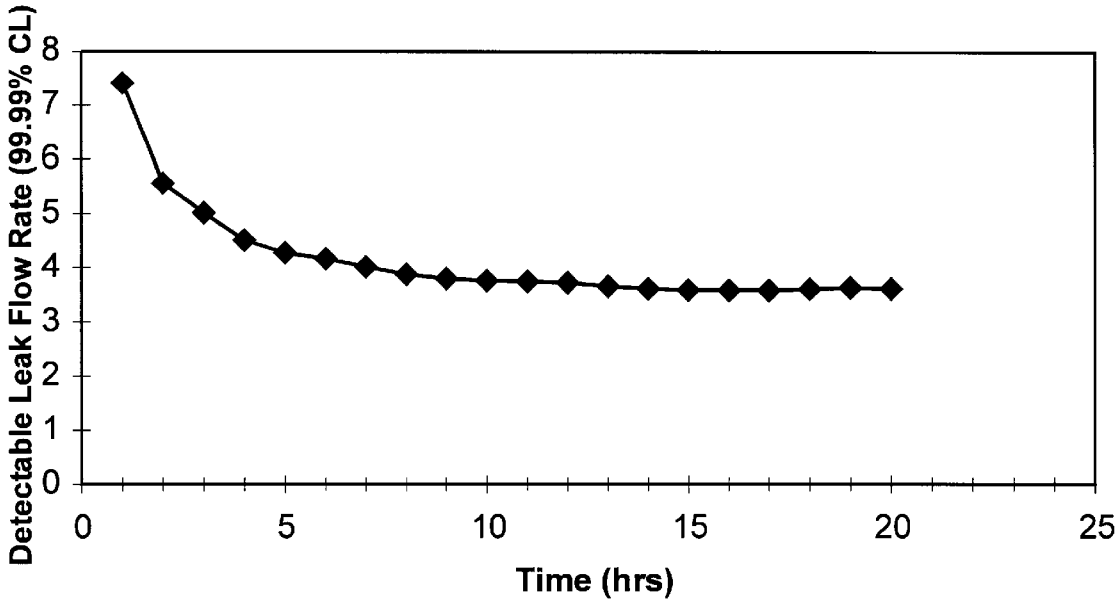
FIG. 11 depicts water mass balance detection limits as a function of time generated by the system/method of the present invention.

An example of a step leak was assumed in FIG. 11 for a water mass balance system.

For simplicity, the calculation was done using a step-change leak. Other leak shapes can also be used. The detectable leak flow rate varies with time. Sensitivity to detect smaller leaks improves with time. As shown in FIG. 11, the leak detection system detects a 7.5 klb/hr leak flow in one hour, but would be two hours before the leak detection system responds to a 5.5 klb/hr leak. Eventually the improved sensitivity levels off at approximately 3.5 klb/hr at times greater than 10 hours. As explained above, the curve shape and detection limit at the asympote are a function of the noise characteristics of individual boilers.

Another example utilizes a water mass balance leak detection system that has been installed for about two years in a southern paper mill recovery boiler. The performance of this system was monitored closely for an eight month period following its installation. The evaluation included physical and software leaks as well as evaluation of the number and duration of false alarms and downtime of the leak detection system.

The system was first tuned (calibrated). The detection limit vs. time profile shown in FIG. 11 was generated. Then four leak tests were conducted over a six day period. Two were software leaks, i.e., where the leak flow was mathematically added to the incoming water mass balance flows. Two were physical leaks where a valve in the mill was actually opened.

Output for these simulated leaks are shown in Table 4. The installed WMB leak detection system detected the four leaks in times ranging from 15 minutes for the 14 klb/hr leak to 150 minutes for the 3.8 klb/hr software leak.

Figure 12:
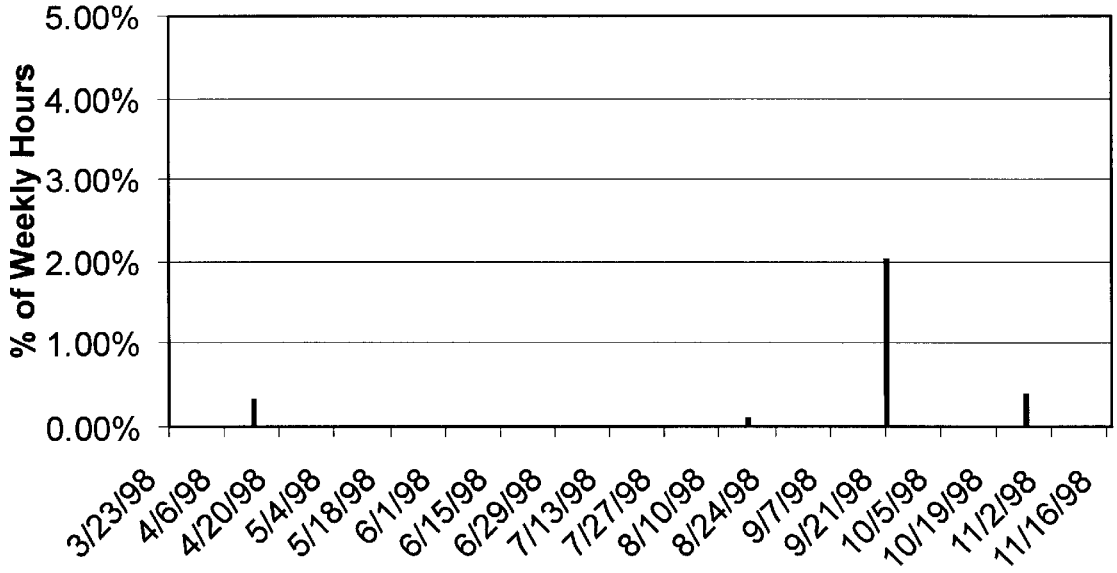
FIG. 12 depicts the water mass balance alarm limit activation history of FIG. 11.

With this chosen level of sensitivity, the false alarm and downtime performance for the system was monitored for an eight month period. The results are shown in FIG. 12 and Table 5. There were four false alarms. In each case, the alarm was associated with an unexplained change in the relative rates of the water and steam flows in the boiler. Half of the 5% downtime was related to two boiler startups in the eight month period. The other 2.5% were related to the leak detection system taking itself offline to avoid potential false alarm situations.

Figure 13:
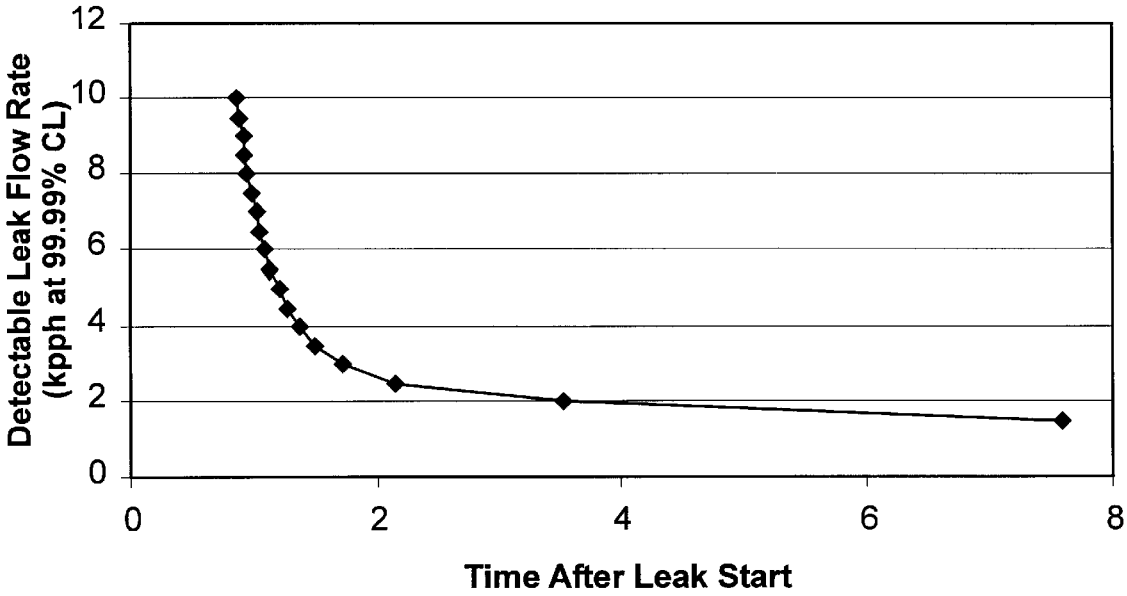
FIG. 13 depicts chemical mass balance detection limits as a function of time generated by the system/method of the present invention.
Figure 14:
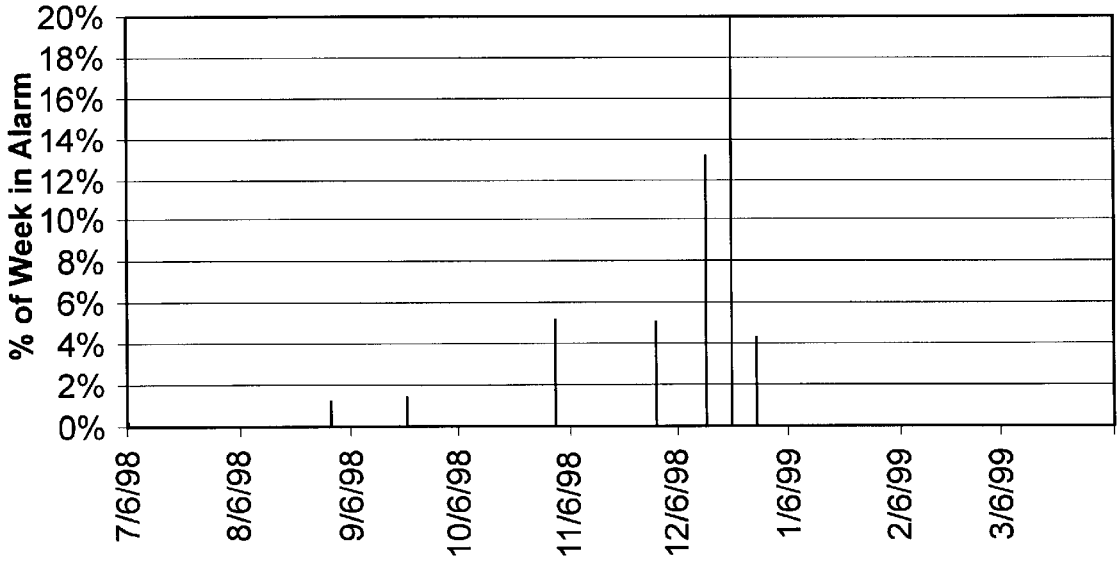
FIG. 14 depicts the water mass balance alarm limit activation history of FIG. 13.

Another example utilizes a chemical mass balance system has been installed for about six years in a southern paper mill recovery boiler. The performance of this leak detection system was monitored closely for an eight month period. The evaluation included a physical leak test, assessment of the number and duration of false alarms, and downtime of the leak detection system. The system was tuned with the resulting sensitivity vs. time graph shown in FIG. 13. After the system was tuned (calibrated) for this particular boiler, a leak test was conducted using a flow through a metered valve. The flow was set to 1.75 klb/hr and an alarm was detected approximately six hours after flow was started. This is about what would be expected from the data shown in FIG. 12. During this period, there was also a sight glass leak which the system responded to as expected, detecting the leak. The alarm history is shown in FIG. 14 and downtime history is shown in Table 6.

There are a number of pitfalls and practical issues associated with chemical and water mass balance leak detection. Without methods to compensate for these, any leak detection system developed is subject to poor sensitivity, high false alarm rates, and/or extensive downtime. By utilizing the method 20 of the present application, any mass balanced-based recovery boiler leak detection system can be characterized in order to present boiler operator with tradeoffs among sensitivity, false alarms and offline times.

It should be understood that the method 20 is preferably implemented in software for use in a computer but is not limited to that particular embodiment, e.g, many of the steps of the method 20 could be implemented in hardware. Thus, it is within the broadest scope of the invention to include the method 20 in any form known to those skilled in the art.

Without further elaboration, the foregoing will so fully illustrate our invention and others may, by applying current or future knowledge, readily adapt the same for use under various conditions of service.

TABLE 1

Noise Associated with Water Mass Balance at Stable Load

| Boiler | Standard Deviation Expressed as % of Nominal Steam Flow |
|---|---|
| Boiler 1 (Time 1) | 3.2% |
| Boiler 2 (Time 1) | 8.8% |
| Boiler 2 (Time 2) | 3.6% |
| Boiler 2 (Time 3) | 5.1% |
| Boiler 3 (Time 1) | 2.0% |
| Boiler 3 (Time 2) | 2.3% |
| Boiler 4 (Time 1) | 2.4% |
| Boiler 4 (Time 2) | 4.6% |
| Boiler 5 (Time 1) | 5.0% |
| Boiler 5 (Time 2) | 3.6% |

TABLE 2

Noise Associated with Chemical Mass Balances at Stable Load and Steady State Chemical Concentrations

| Boiler | Time Period | % RSD* of BD Flow | % RSD* of BD Chemical Concentration | % RSD* of Chemical Feed |
|---|---|---|---|---|
| Boiler 5 | 1 week | 0.4 | 0.5 | 0.005 |
| Boiler 3 | 1 week | 1.4 | 0.8 | 0.15 |
| Boiler 6 | 1 week | 1.2 | 3.6 | — |

Chemical concentration fixed
*% RSD = % Relative Standard Deviation

TABLE 3

Effect of No Load Corrections on False Alarms

| | Boiler 3 | Boiler 4 | Boiler 5 | Boiler 6 | Boiler 7 |
|---|---|---|---|---|---|
| Mean Time (days) Between False Alarms | 16.7 | 15.2 | 7.3 | 14.7 | 10.3 |
| % Time in False Alarm due to absence of load corrections | 2.9% | 1.7% | 8.6% | 9.4% | 3.5% |

TABLE 4

Results of Water Mass Balance Leak Tests

| Simulated Leak Tests | Time to Detect Leak (min) |
|---|---|
| 7.5 klb/hr (software, Day 1) | 25 |
| 3.8 klb/hr (software, Day 4) | 150 |
| ~3.8 klb/hr (physical, Day 5) | ~45 |
| ~14 klb/hr (physical, Day 6) | 15 |

TABLE 5

Water Mass Balance Downtime History (Eight-Month Period)

| Downtime | % of Total Boiler Time |
|---|---|
| Total (excluding boiler downtime) | 4.97% |
| Startup | 2.48% |
| Other | 2.48% |

TABLE 6

Chemical Mass Balance Downtime History (Nine-Month Period)

| Cause of Downtime | % Downtime | % Downtime (12/98) | % Downtime (excluding 12/98) |
|---|---|---|---|
| Phosphate analyzer | 12% | 82% | 2% |
| Leak detection offline (including analyzer down) | 18% | 83% | 12% |

We claim:

1. A method for presenting tradeoffs of the sensitivity and false alarms of a recovery boiler leak detection system, said method comprising the steps of:

(a) obtaining leak-free operational data from the recovery boiler;

(b) specifying a leak probability estimating filter that uses a statistical noise model and a model of how typical leaks grow over time;

(c) generating a numerical indicator from said filter and said operational data, said numerical indicator having an output that is a measure of leak likelihood;

(d) selecting an alarm limit for said recovery boiler leak detection system wherein if said output of said numerical indicator exceeds said limit, an alarm is activated in said recovery boiler leak detection system;

(e) determining the sensitivity of the leak detection system from one of a first sequence of numerical indicator outputs that exceeds said alarm limit in the least amount of time, said first sequence of numerical indicator outputs being generated from simulated recovery boiler inputs and an assumed leak that are fed into said filter;

(f) determining the number of false alarms from a second sequence of numerical indicator outputs that exceed said alarm limit, said second sequence of numerical indicator outputs being generated by a sequence of said operational leak-free data fed into said filter; and (g) presenting tradeoffs among said sensitivity and false alarms.

2. The method of claim 1 further comprising:

(a) modifying said at statistical noise model or said model of how typical leaks grow over time;

(b) generating a new numerical indicator having an output that is a measure of leak likelihood from said modified statistical noise model or from said modified model of how typical leaks grow over time;

(c) selecting an alarm limit for said recovery boiler leak detection system wherein if said new numerical indicator output exceeds said limit, an alarm is activated in said recovery boiler leak detection system;

(d) inputting said simulated recovery boiler inputs into said modified statistical noise model or into said modified model of how typical leaks grow over time to generate a third sequence of numerical indicator outputs corresponding to said sequence of leak flow rates;

(e) determining the time it takes until the first one of said third sequence of numerical indicator outputs exceeds said alarm limit, thereby defining a new sensitivity;

(f) inputting said sequence of said operational leak-free data into said modified statistical noise model or into said modified model of how typical leaks grow over time to generate a fourth sequence of numerical indicator outputs corresponding to said sequence of said operational leak-free data;

(g) determining the number of times that said alarm limit is exceeded by said fourth sequence of numerical indicator outputs, thereby defining new false alarms; and (h) presenting treadeoffs among said new sensitivity and new false alarms.

3. A method for presenting tradeoffs of the sensitivity and false alarms of a recovery boiler leak detection system, said method comprising the steps of:

(a) obtaining leak-free operational data from the recovery boiler;

(b) specifying a leak probability estimating filter;

(c) generating a numerical indicator from said filter and said operational data, said numerical indicator having an output that is a measure of leak likelihood and comprises a leak probability statistic, said leak probability statistic comprising a standardized maximum likelihood standardized leak flow;

(d) selecting an alarm limit for said recovery boiler leak detection system wherein if said output of said numerical indicator exceeds said limit, an alarm is activated in said recovery boiler leak detection system;

(e) determining the sensitivity of the leak detection system from one of a first sequence of numerical indicator outputs that exceeds said alarm limit in the least amount of time, said first sequence of numerical indicator outputs being generated from simulated recovery boiler inputs and an assumed leak that are fed into said filter;

(f) determining the number of false alarms from a second sequence of numerical indicator outputs that exceed said alarm limit, said second sequence of numerical indicator outputs being generated by a sequence of said operational leak-free data fed into said filter; and (g) presenting tradeoffs among said sensitivity and false alarms.

* * * * *